US006652319B1

(12) United States Patent
Billman

(10) Patent No.: US 6,652,319 B1
(45) Date of Patent: Nov. 25, 2003

(54) HIGH SPEED CONNECTOR WITH MATCHED IMPEDANCE

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/217,931

(22) Filed: Aug. 12, 2002

Related U.S. Application Data

(63) Continuation-in-part of application No. 10/154,318, filed on May 22, 2002.

(51) Int. Cl.[7] ..... H01R 13/648

(52) U.S. Cl. ..... 439/608; 439/108

(58) Field of Search ..... 439/608, 701, 439/108, 101

(56) References Cited

U.S. PATENT DOCUMENTS

| | | | | |
|---|---|---|---|---|
| 5,713,764 A | | 2/1998 | Brunker et al. | |
| 5,895,278 A | | 4/1999 | Humphrey | |
| 5,993,259 A | * | 11/1999 | Stokoe et al. | 439/608 |
| 6,019,639 A | | 2/2000 | Brunker et al. | |
| 6,053,751 A | | 4/2000 | Humphrey | |
| 6,083,047 A | * | 7/2000 | Paagman | 439/608 |
| 6,234,807 B1 | | 5/2001 | Amini et al. | |
| 6,238,245 B1 | * | 5/2001 | Stokoe et al. | 439/608 |
| 6,267,604 B1 | * | 7/2001 | Mickievicz et al. | 439/608 |
| 6,347,962 B1 | * | 2/2002 | Kline | 439/608 |
| 6,435,914 B1 | * | 8/2002 | Billman | 439/608 |

OTHER PUBLICATIONS

James H. Wise, Connector Applications, Electronic Connector Handbook (Robert S. Mroczkowski), pp. 12.10–12.16, Published in 1998 in the U.S.A. by the McGraw–Hill Companies, Inc.

* cited by examiner

*Primary Examiner*—Gary Paumen
(74) *Attorney, Agent, or Firm*—Wei Te Chung

(57) ABSTRACT

An electrical connector (50) includes a first housing member (52), a second housing member (60) attached to the first housing member by a cap (68), a plurality of contacts (64) and a plurality of grounding buses (66) assembled to the second housing member and a plurality of printed substrates (10) assembled to the first and second housing members. Each printed substrate has a first edge (28) adjacent a front face (56) of the first housing member, a perpendicular second edge (30) received in a slot (62) of the second housing member. The printed substrate has a plurality of couples of traces (14) and a plurality of grounding coatings (22) in on a first surface thereof and each grounding coating is located between two adjacent couples of traces. The printed substrate further has a row of first conductive pads (16) adjacent the first edge and a row of second conductive pads (18) adjacent the second edge and both rows are on the first surface. The first and the second conductive pads are electrically interconnected via the conductive traces. Each first conductive pad includes a first section (34) connected to the conductive trace and a second section (38) close to the first edge. The first section is slimmer than the second section for controlling the impedance of the route of the conductive pads and the conductive trace. The printed substrate has a grounding coating (24) on an opposite second surface (26) for controlling the impedance of the route of the trace and the conductive pads.

1 Claim, 10 Drawing Sheets

HIGH SPEED CONNECTOR WITH MATCHED IMPEDANCE

CROSS-REFERENCE TO RELATED APPLICATIONS

This application is a continuation-in-part (CIP) application of U.S. patent application Ser. No. 10/154,318, filed on May 22, 2002; U.S. patent application Ser. No. 10/152,936, filed on May 21, 2002; U.S. patent application Ser. No. 10/162,724, filed on Jun. 4, 2002, entitled "HIGH DENSITY ELECTRICAL CONNECTOR WITH LEAD-IN DEVICE", invented by Timothy Brain Billman and Iosif Korsunsky; and U.S. patent application Ser. No 10/161,471, filed on May 30, 2002, entitled "HIGH DENSITY ELECTRICAL CONNECTOR WITH IMPROVED GROUNDING BUS", invented by Timothy Brain Billman and Iosif Korsunsky; and is a co-pending application of U.S. patent application Ser. No. 10/192,048, filed on Jul. 9, 2002, entitled "REDUPLICATE USE OF THE SAME CONDUCTIVE MODULE IN HEADER AND RECEPTACLE", invented by Timothy Brain Billman, Eric Daniel Juntwait and Iosif Korsunsky; U.S. patent application Ser. No. 10/165,561 filed on Jun. 7, 2002, entitled "GROUNDING OF THE OUTER SHELL OF THE BACKPLANE CONNECTOR", invented by Timothy Brain Billman; and U.S. patent application Ser. No 10/165,596, filed on Jun. 7, 2002, entitled "EXTENDING SHIELD PROVIDED BY GROUNDING BUS", invented by Timothy Brain Billman and Eric Daniel Juntwait. All the above patent applications are assigned to the same assignee as the present patent application.

BACKGROUND OF THE INVENTION

1. Field of the Invention

The present invention relates to a connector, and particularly to a high speed connector having a controlled impedance.

2. Description of Related Art

With the development of communication and computer technology, high speed electrical connectors are more and more desired. There have already been several high speed electrical connectors available in the market, for example, Molex's Very High Density Metric (VHDM) connectors (note: VHDM is a registered trademark of Teradyne, Inc.), and AMP's Speedpac backplane connectors. One of the main problems of these high speed electrical connectors is the crosstalk in the connectors which deteriorates the quality of signal transmission seriously. It is a principle that the higher the speed is, the more serious the cross-talk problem becomes. It has been known by persons skilled in the art that matched impedance at interfaces of the connectors is critical to eliminate the cross-talk problem. A book entitled "ELECTRONIC CONNECTOR HANDBOOK", edited by Robert S. Mroczkowski, discloses in its chapter 12, pages 10–16 that allocating a number of pins as grounds in an open pin field connector is helpful to control the impedance of the connectors. Minimizing the distance between a signal pin and adjacent grounding pins improves electronic performance of the connector. Providing grounding pins around signal pins also reduces crosstalk. U.S. Pat. No. 5,713,764, assigned to Molex and issued on Feb. 3, 1998; U.S. Pat. No. 5,895,278, assigned to Thomas & Betts and issued on Apr. 20, 1999; U.S. Pat. No. 6,019,639, assigned to Molex and issued on Feb. 1, 2000; and U.S. Pat. No. 6,053,751, assigned to Thomas & Bitts and issued on Apr. 25, 2000 all disclose controlled impedance connectors for improving the problem of crosstalk of connectors having high speed transmission.

SUMMARY OF THE INVENTION

Accordingly, an objective of the present invention is to provide a high speed electrical connector with matched impedance so that crosstalk of the connector is significantly reduced.

In order to achieve the object set forth, an electrical connector includes a first housing member, a second housing member attached to the first housing member by a cap, a plurality of contacts and a plurality of grounding buses assembled to the second housing member and a plurality of printed substrates assembled to the first and second housing members. Each printed substrate has a first edge adjacent a front face of the first housing member, a perpendicular second edge received in a slot of the second housing member. The printed substrate has a plurality of couples of traces and a plurality of grounding coatings in on a first surface thereof and each grounding coating is located between two adjacent couples of traces. The printed substrate further has a row of first conductive pads adjacent the first edge and a row of second conductive pads adjacent the second edge and both rows are on the first surface. The first and the second conductive pads are electrically interconnected via the conductive traces. Each first conductive pad includes a first section connected to the conductive trace and a second section close to the first edge. The first section is slimmer than the second section for controlling the impedance of the route of the conductive pads and the conductive trace. The printed substrate has a grounding coating on an opposite second surface for controlling the impedance of the route of the trace and the conductive pads.

Other objects, advantages and novel features of the invention will become more apparent from the following detailed description when taken in conjunction with the accompanying drawings.

BRIEF DESCRIPTION OF THE DRAWINGS

FIG. 6 is a perspective view of a second-type electrical connector in accordance with the present invention, and a complementary header connector that the second-type electrical connector is to mate with;

DETAILED DESCRIPTION OF THE INVENTION

Figure 1:
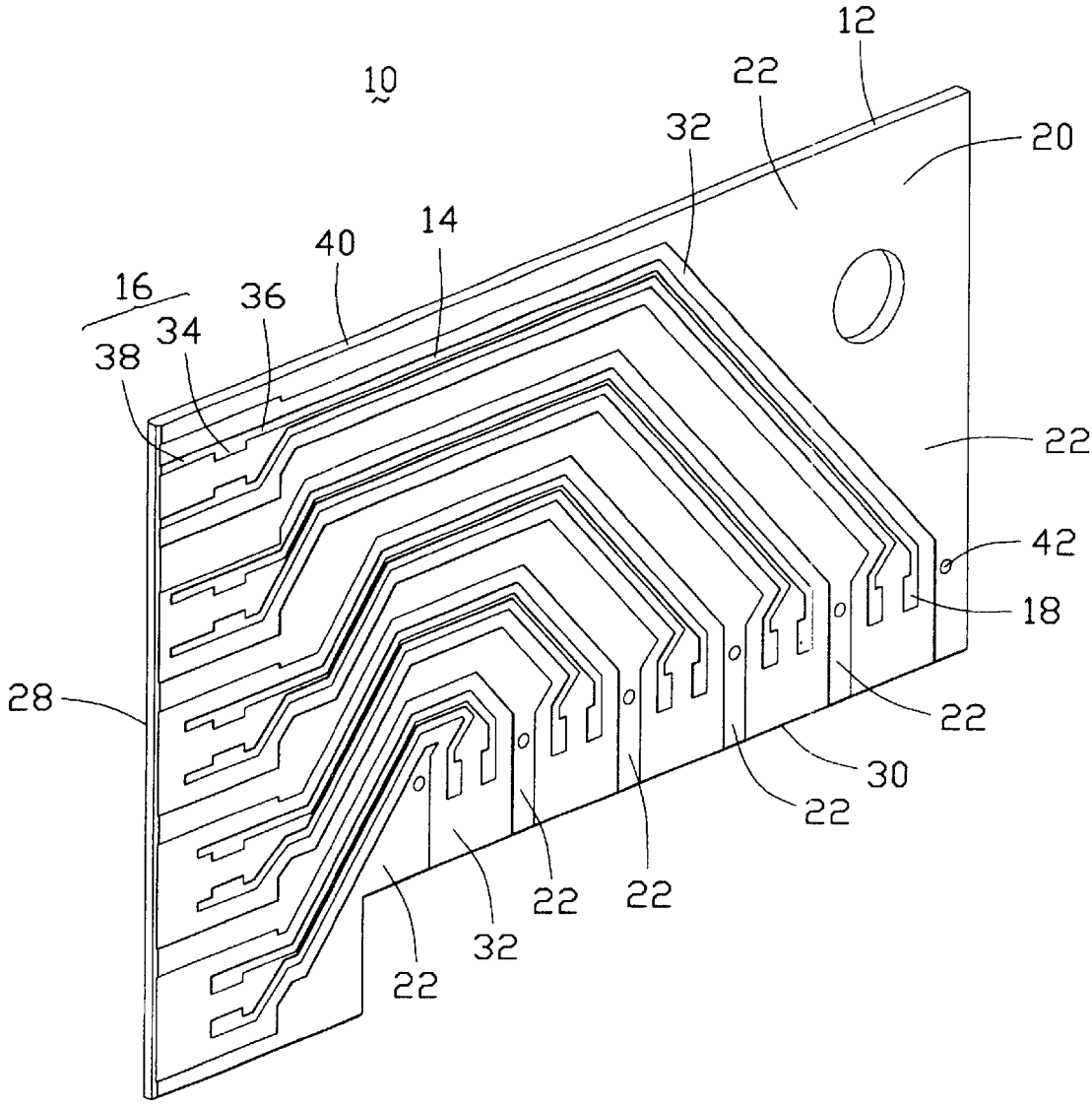
FIGS. 1 and 2 are two perspective views in opposite aspects of a printed substrate which is an element of an electrical connector of the present invention.
Figure 2:
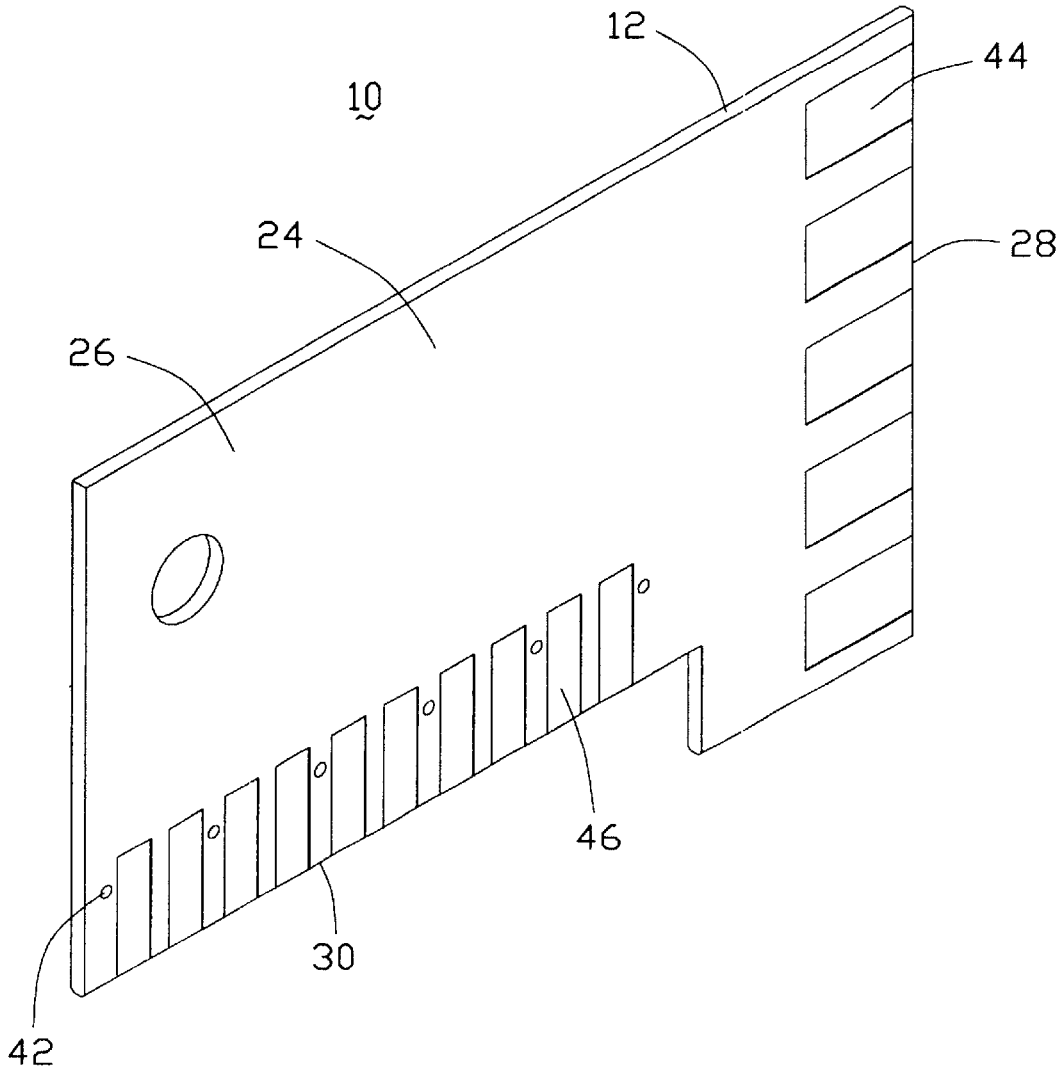

Referring to FIGS. 1 and 2, a printed substrate 10 according to the present invention includes an insulative base 12, a plurality of conductive traces 14 and a row of first conductive pads 16 a row of second conductive pads 18 on a first surface 20 of the insulative base 12, and metallic coatings 22, 24 on the first surface 20 and an opposite second surface 26 thereof, respectively. The metallic coatings 22, 24 (preferably copper coatings) are provided for grounding purpose. The first conductive pads 16 are located adjacent a first edge 28 of the substrate 10 and are electrically connected via the conductive traces 14 with corresponding second conductive pads 18 which are located adjacent a second edge 30 of the substrates 10. The first edge 28 is generally perpendicular with the second edge 30. The conductive traces 14 are arranged in couples and the conductive traces 14 of each couple are spaced from each other as close as possible so that the conductive traces 14 of adjacent couples are spaced from each other a large distance. Between every two adjacent couples of conductive traces 14, there is the metallic coating 22 to provide a separation of noise interference therebetween. The conductive traces 14 are electrically insulated from each other and from the grounding coatings 22 by insulative coatings 32 therebetween. The metallic coating 24 substantially covers the whole second surface 26 and electrically connects the metallic coatings 22 on the first surface 20 via metal-plated holes 42 which are defined through the first and second opposite surfaces 20, 26 of the printed substrate 10. On the second surface 26, there are a plurality of conductive pads 44, 46 adjacent the first and the second edges 28, 30 of the printed substrate 10, respectively. The conductive pads 16, 18, 44 and 46 are preferably gold fingers.

Some of the first conductive pads 16 each include a first section 34 electrically connecting an end 36 of a corresponding conductive trace 14 and a second section 38 electrically bridging the end 36 via the first section 34. The second section 38 is located closer to the first edge 28 but farther from the end 36 than the first section 34. The second section 38 has a width so defined by viewing the second section 38 from a direction of the first edge 28. The width is dimensioned to be slimmer than that of the first section 34 in such an amount that the impedance of the route of the conductive trace 14 together the first and second conductive pads 16, 18 is adjusted/controlled to match with a set value of the impedance of an interconnection system including a connector having the printed substrate 10. In an embodiment of the invention, the width of the second section 38 is a half of the width of the first section 34. The second sections 38 of the first conductive pads 16 have different lengths and the closer the first conductive pad 16 is to a top edge 40 of the printed substrate 10, the longer the second section 38 is. The longest second section 38 extends to the first edge 28 while the first conductive pads 16 of the lowest couple of conductive traces 14 located near the second edge 30 do not have the second section. When the printed substrate 10 mates with a complementary connector (not shown), contacts of the complementary connector slide over the second sections 38 of the first conductive pads 16 and finally stay on corresponding first sections 34.

Figure 3:
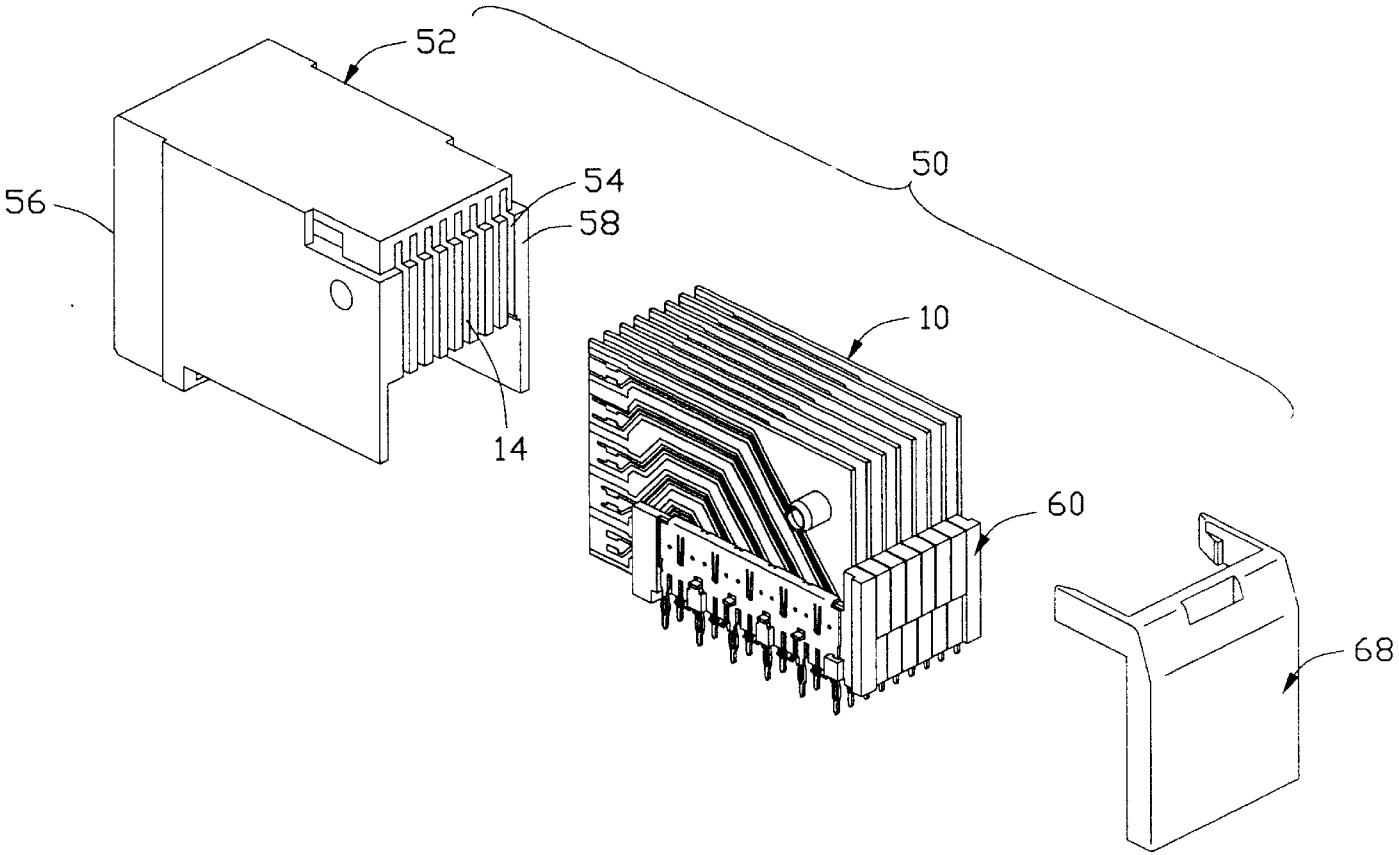
FIG. 3 is an exploded perspective view of a first-type electrical connector in accordance with the present invention, the connector having the printed substrate of FIGS. 1 and 2 therein.
Figure 4:
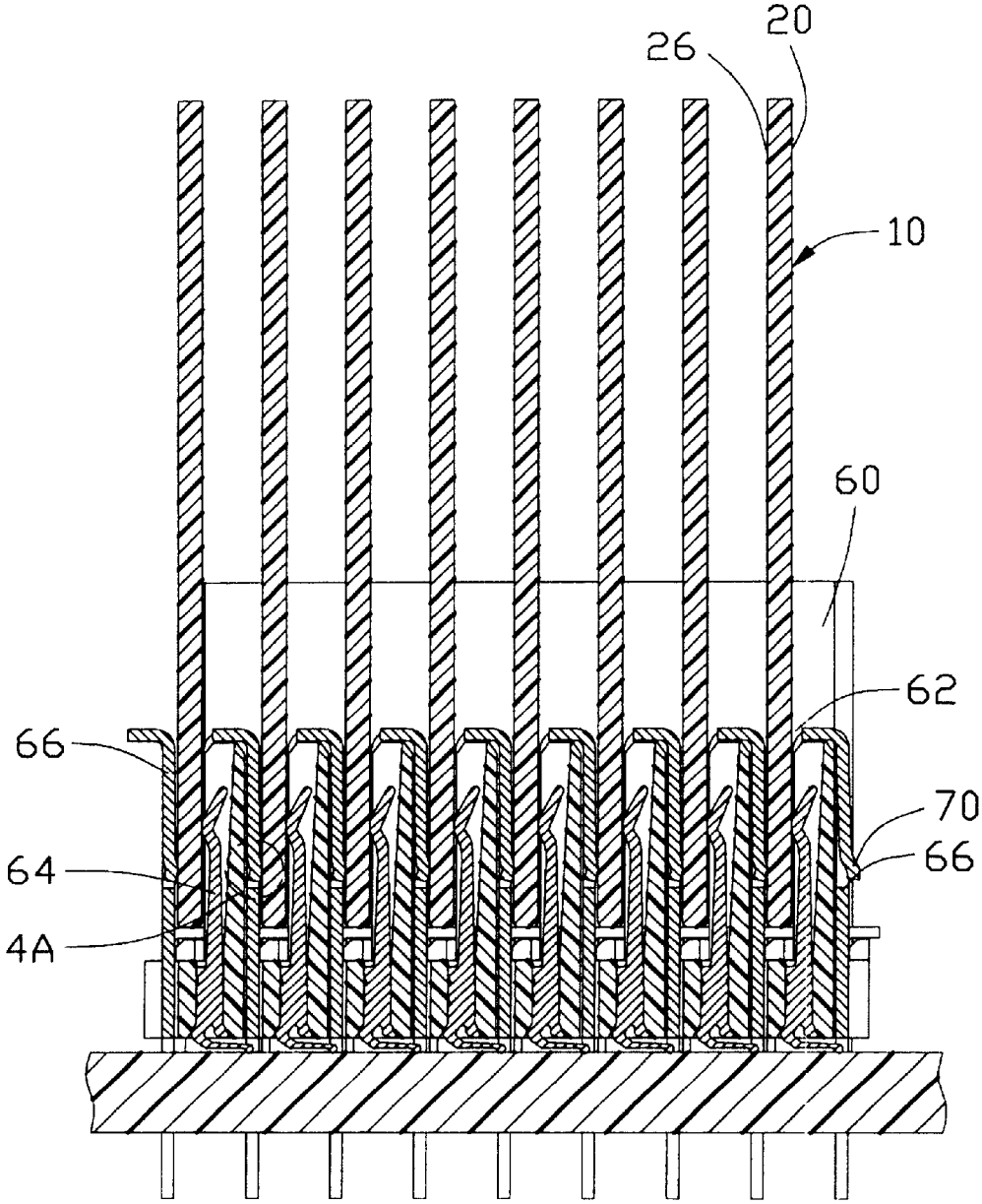
FIG. 4 is a cross-sectional view of the first-type electrical connector of FIG. 3, in which the connector is mounted on a mother board.
Figure 4A:
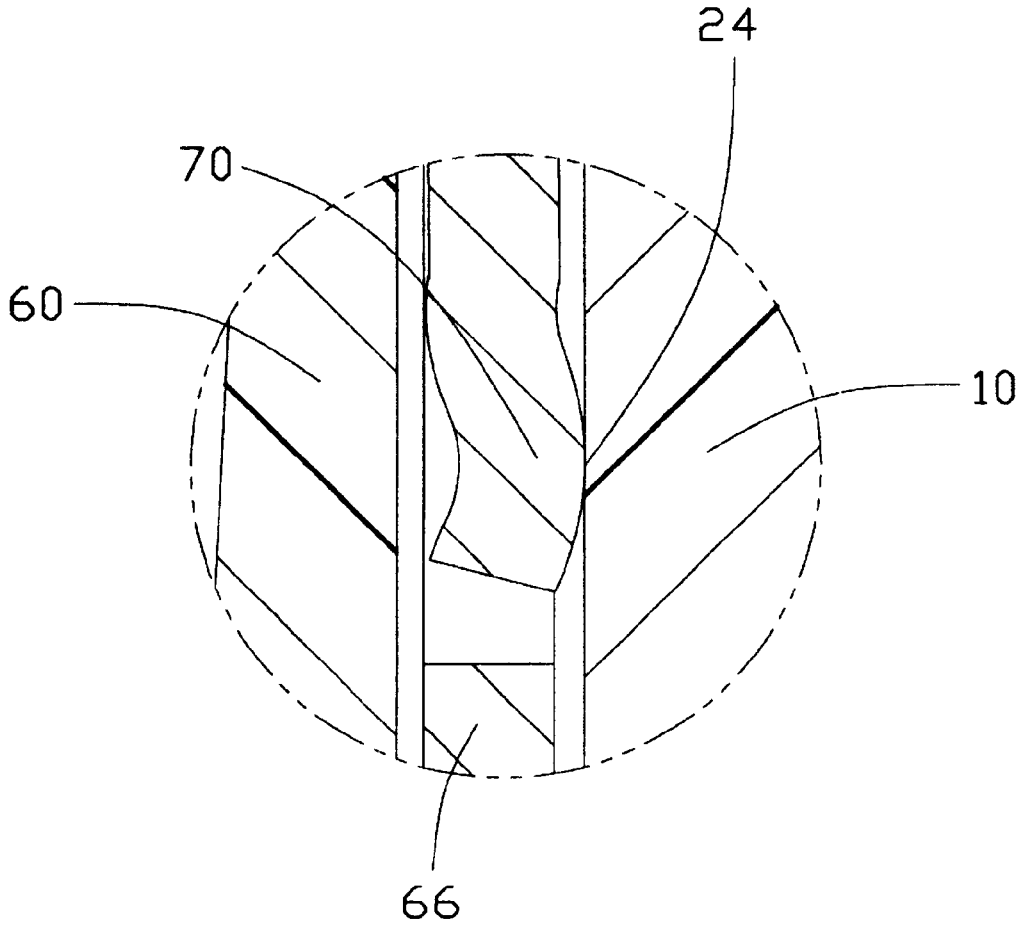
FIG. 4A is an enlarged view of a circled part 4A of FIG. 4.
Figure 5:
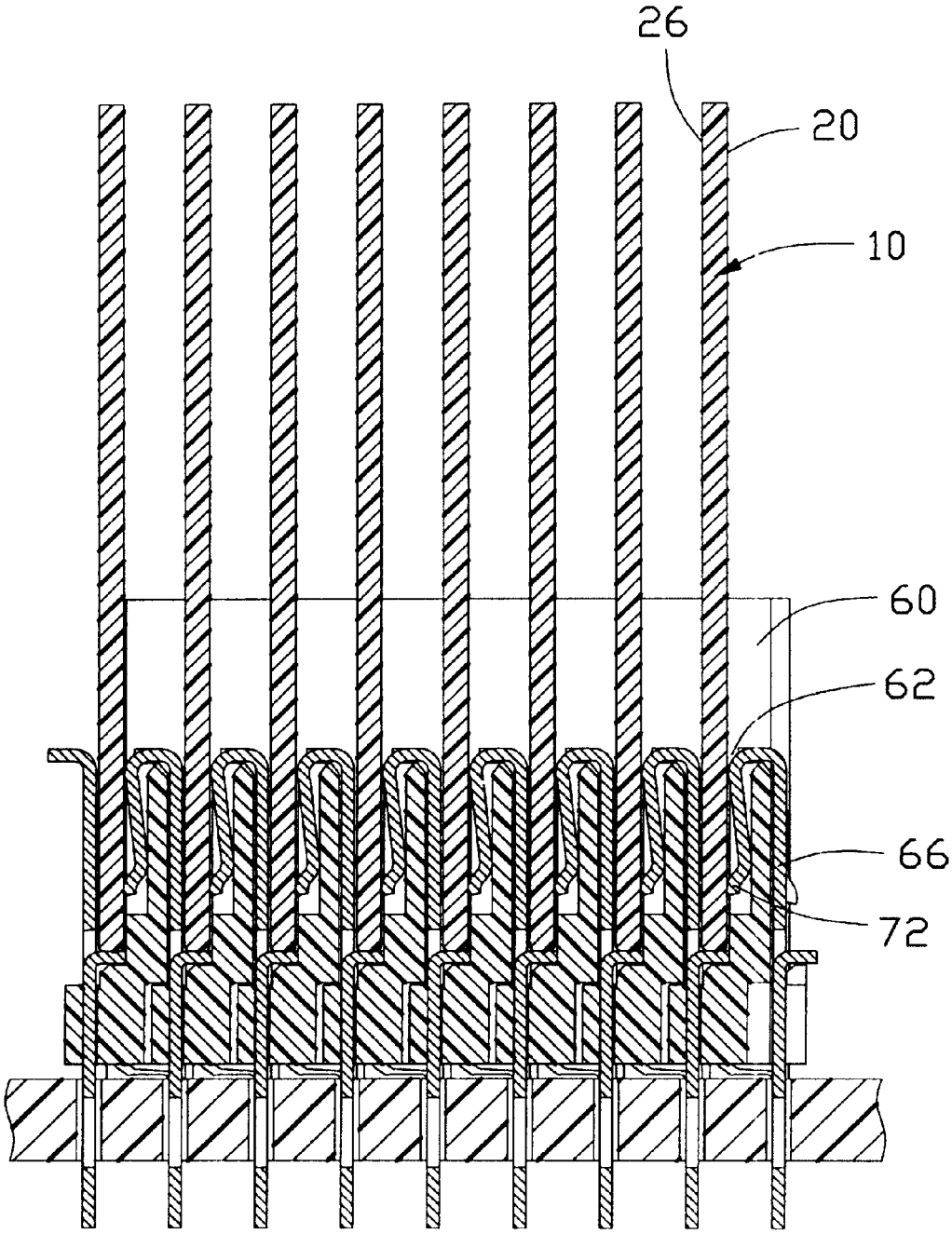
FIG. 5 is another cross-sectional view of the first-type electrical connector of FIG. 3.

FIGS. 3–5 illustrate a first-type electrical connector 50 in accordance with the present invention, the connector 50 has a plurality of the printed substrates 10 therein. The electrical connector 50 includes a first housing member 52 defining multiple parallel channels 54 through a front face 56 to a rear face 58 thereof, a second housing member 60 defining a corresponding number of slots 62 aligning with the channels 54, a plurality of conductive contacts 64 and grounding buses 66 attached to opposite peripheral walls of the slots 62. The multiple printed substrates 10 are received in the channels 54 and the slots 62. A cap 68 is provided for securing the second housing member 60 to the first housing member 52. In the slots 62, the second conductive pads 18 electrically connect corresponding conductive contacts 64 and the grounding coatings 22, 24 electrically connect spring tabs 70 and spring arms 72 of corresponding grounding buses 66 (FIGS. 4A and 5). Details of the first-type electrical connector 50 and a mating connector (not shown) are disclosed in the parent U.S. patent application Ser. No. 10/161,471, filed on May 30, 2002, entitled "HIGH DENSITY ELECTRICAL CONNECTOR WITH IMPROVED GROUNDING BUS", invented by Timothy Brian Billman and Iosif Korsunsky, and assigned to the same assignee as this patent application. The whole disclosure of the parent application is incorporated herein by reference.

Figure 6:
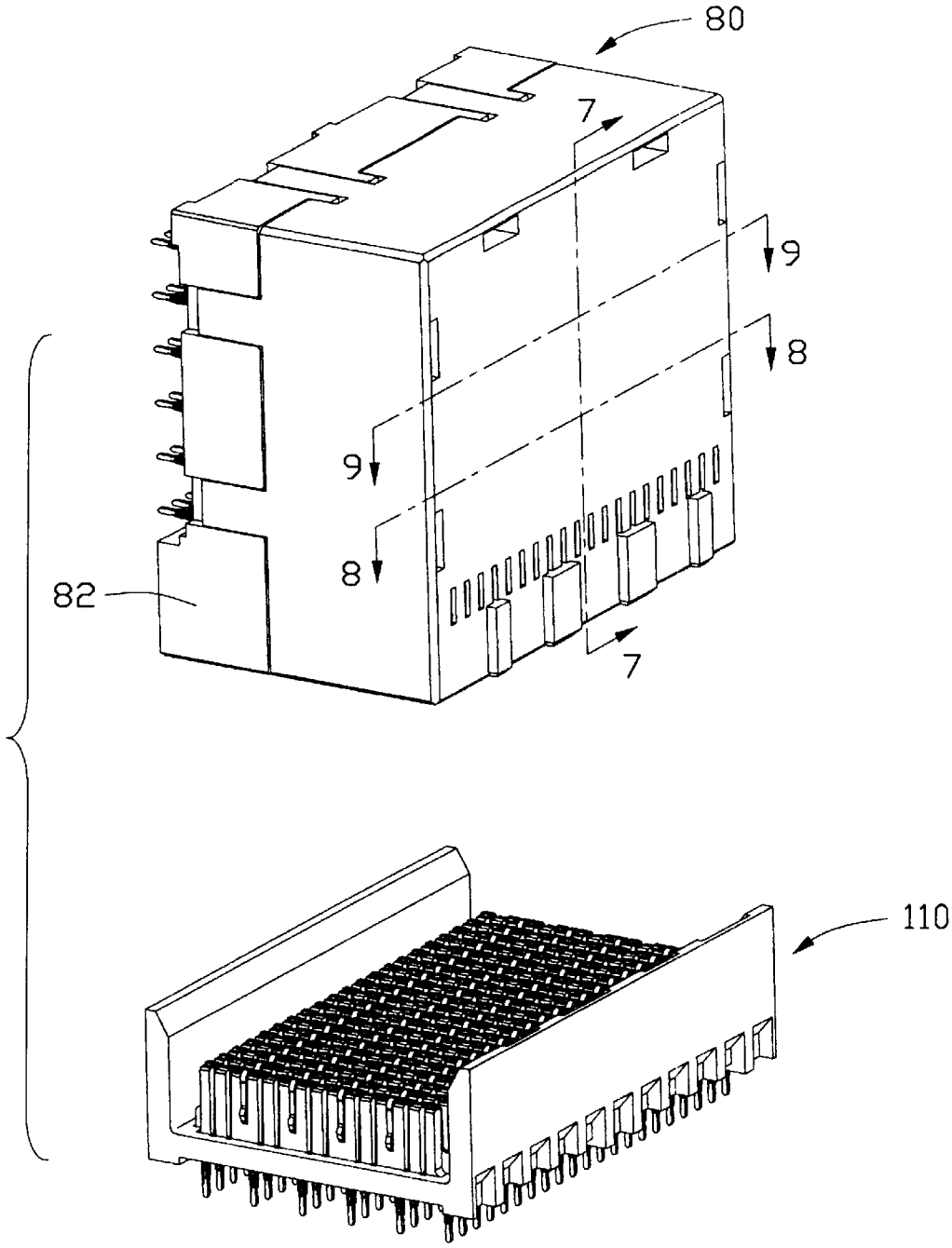
Figure 7:
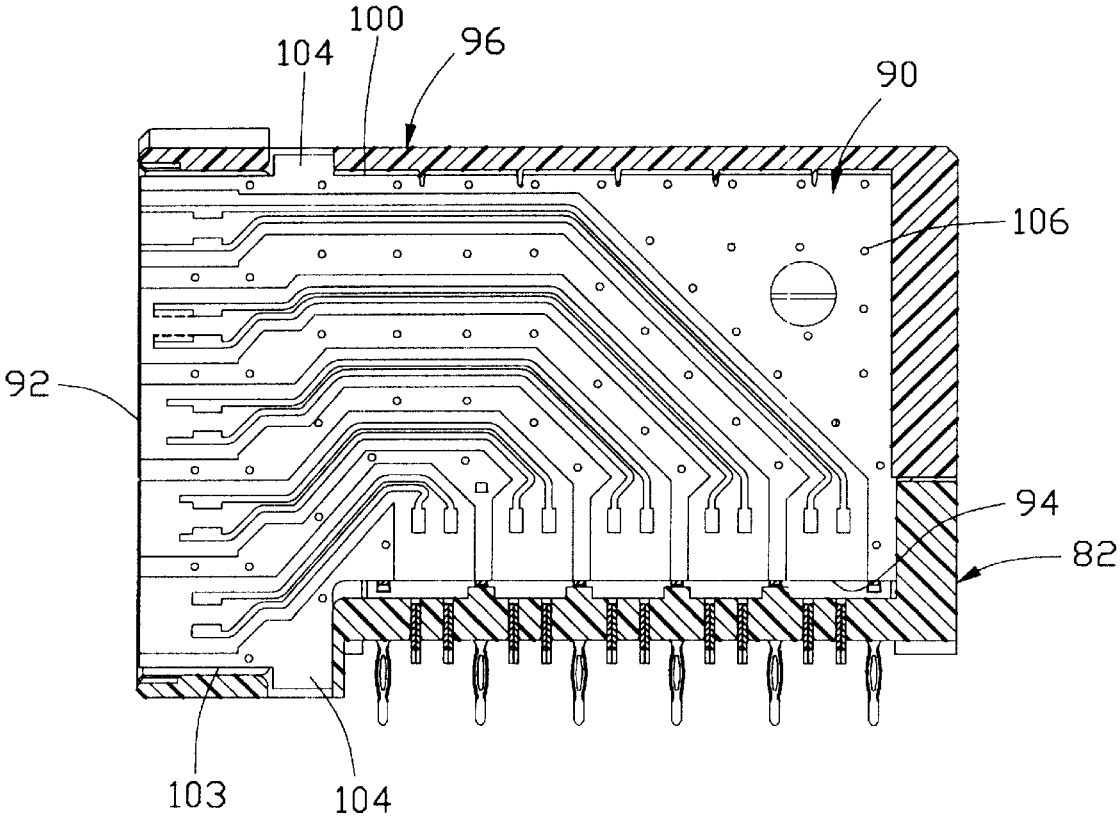
FIG. 7 is a cross-sectional view taken along line 7—7 of FIG. 6.
Figure 8:
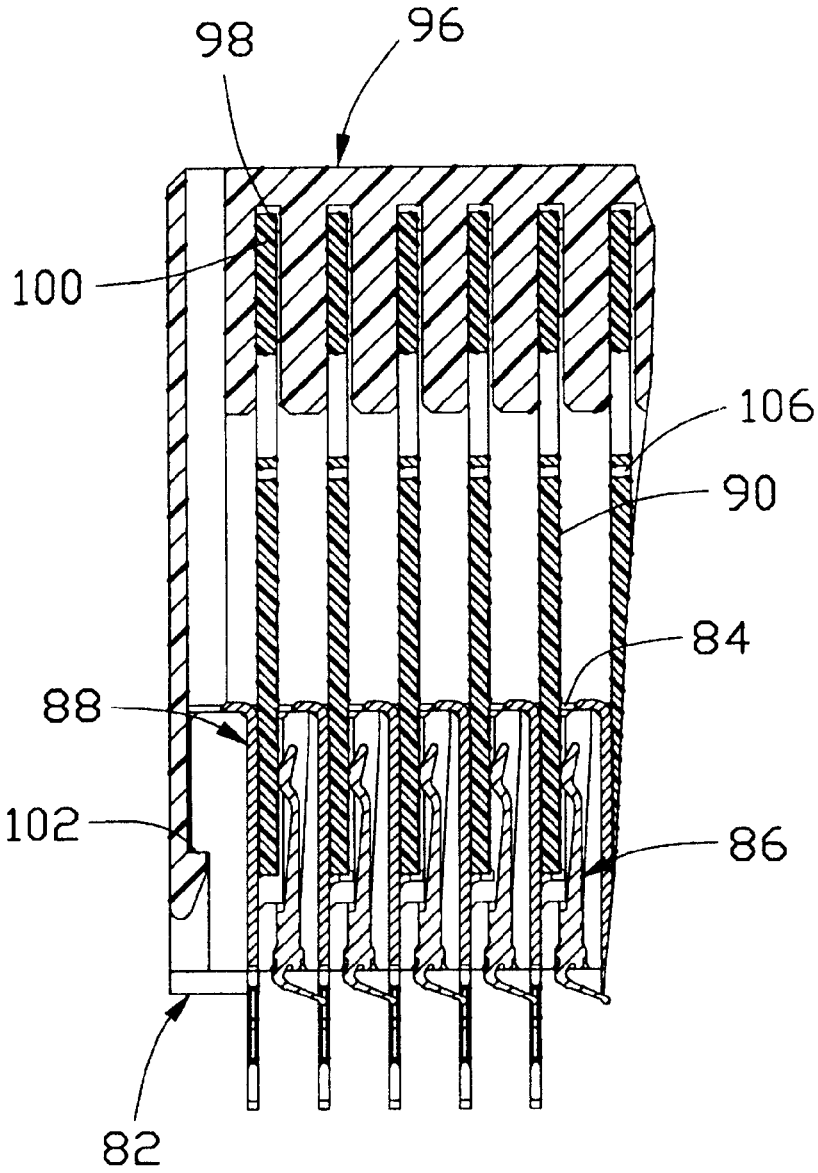
FIG. 8 is a portion of a cross-sectional view taken along line 8—8 of FIG. 6.
Figure 9:
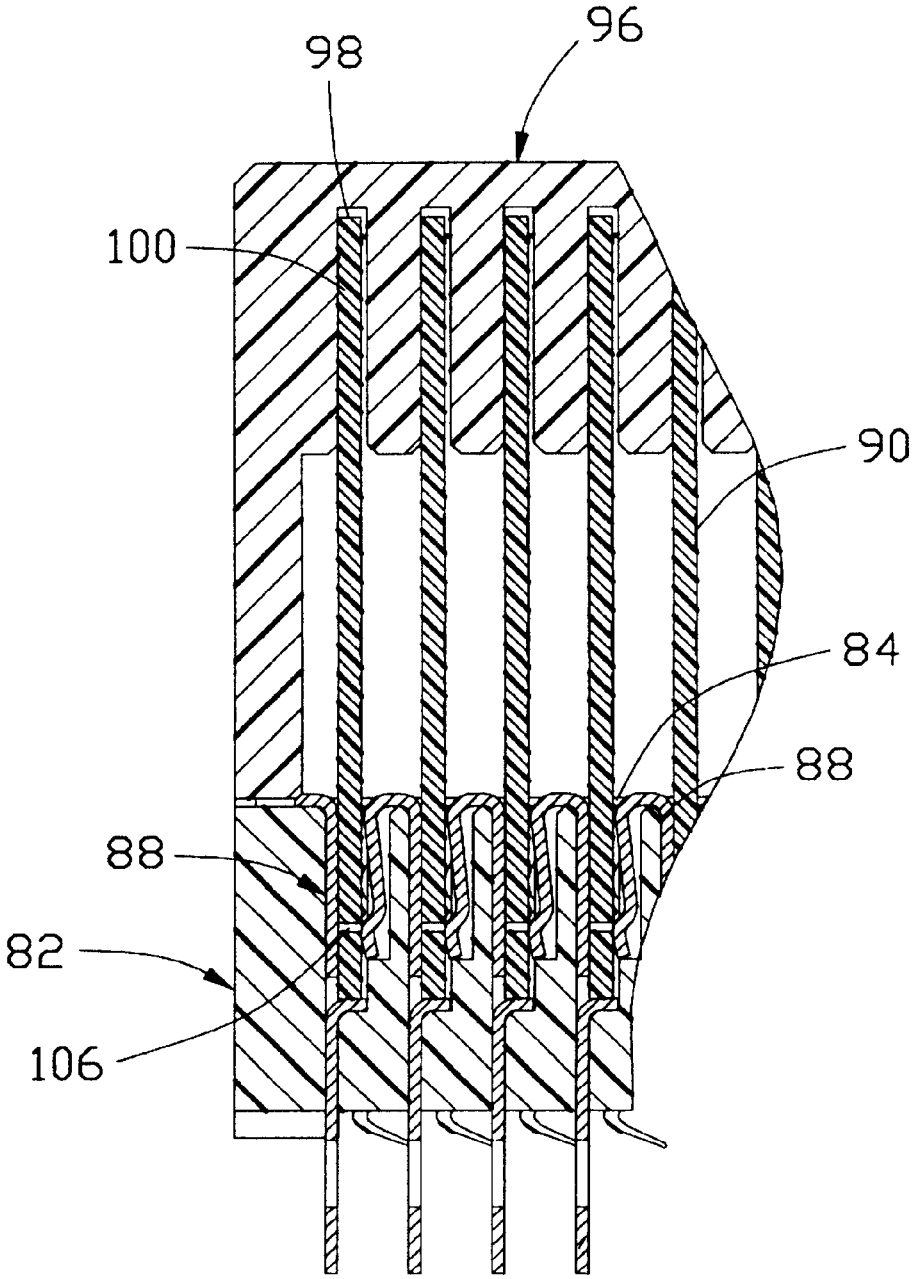
FIG. 9 is a view similar to FIG. 8 but taken along line 9—9 of FIG. 6.

Referring to FIGS. 6–9, a second-type electrical connector 80 in accordance with the present invention includes an insulative base 82 defining a plurality of slots 84, a plurality of conductive contacts 86 and a plurality of grounding buses 88 attached to opposite peripheral walls of the slots 84, a plurality of printed substrates 90 having first edges 92, second edges 94 received in the slots 84 of the insulative base 82 and an insulative cover 96 defining a plurality of slits 98 receiving top edges 100 of corresponding printed substrates 90. The insulative cover 96 is assembled in a top-to-bottom direction to the insulative base 82 by hooks 102 thereof. The printed substrate 90 is very similar to the printed substrate 10 except that the printed substrate 90 further has a key 104 on each of the top edge 100 and a bottom edge 103 for securing the printed substrate 90 to the insulative cover 96 and the insulative base 82. The printed substrate 90 defines a plurality of through-holes 106 with conductive material filled therein for establishing electrical connection between the metallic coatings (not labeled) on opposite surfaces thereof. A header connector 110 mateable with the second-type electrical connector 80 is shown in FIG. 6. Details of the second-type electrical connector 80 and the header connector 110 are disclosed in the parent U.S. patent application Ser. No. 10/152,936, filed on May 21, 2002, and assigned to the same assignee of the present invention. The disclosure of the parent application is incorporated herein by reference.

Due to the specific design of the first conductive pads, the conductive traces and the grounding traces on the printed substrates, the impedance of the electrical connector of the present invention can be well controlled to meet the system requirement. So, the problem of crosstalk in the high speed connector can be significantly improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first housing member having a front face, a rear face and defining a plurality of parallel channels through the front and rear faces;

a second housing member defining a plurality of parallel slots aligning with the parallel channels, the second housing member being attached to the first housing member;

a plurality of conductive contacts attaching to one of opposite peripheral walls of each of the slots of the second housing member; and a plurality of printed substrates received in corresponding channels of the first housing member and corresponding slots of the second housing member, each printed substrate having a row of first conductive pads, a row of second conductive pads and a plurality of conductive traces connecting the first conductive pads to corresponding second conductive pads on a first surface the each printed substrate, the first and the second conductive pads being respectively located adjacent a first and a second perpendicular edges of the printed substrate, the first edges of the printed substrates being adjacent the front face of the first housing member and the second edges of the printed substrates being received in corresponding slots of the second housing member with the row of second conductive pads electrically connecting with corresponding conductive contacts, the first conductive pads each having a first section connecting to a corresponding conductive trace and a second section connecting with the corresponding conductive trace via the first section, the second section having a width which is formed to be slimmer than that of the first section, whereby an impedance of the corresponding conductive trace with the first and second conductive pads can controlled to meet a set value of an impedance of a system;

wherein the conductive traces on the printed substrates are arranged in couples and between each two adjacent couples there is a metallic coating for grounding, the metallic coating blocking noise interference between each two adjacent couples of conductive traces;

further comprising a plurality of grounding buses received in the slots, the grounding buses electrically connecting with the metallic coatings on the printed substrates;

wherein the printed substrates each have a further metallic coating substantially covering a second opposite surface thereof, the further metallic coatings electrically connected to the grounding buses and the metallic coatings on the first surfaces of the printed substrates, respectively.

* * * * *